US005382503A

United States Patent [19]

Murakami et al.

[11] Patent Number: 5,382,503

[45] Date of Patent: Jan. 17, 1995

[54] SILVER HALIDE EMULSION AND SILVER HALIDE PHOTOGRAPHIC LIGHT-SENSITIVE MATERIAL

[75] Inventors: Shuji Murakami; Yukio Ohya, Odawara; Makoto Kaga, Hino, all of Japan

[73] Assignee: Konica Corporation, Japan

[21] Appl. No.: 124,312

[22] Filed: Sep. 20, 1993

[30] Foreign Application Priority Data

Sep. 22, 1992 [JP] Japan ..... 4-253080

[51] Int. Cl.[6] ..... G03C 1/035; G03C 1/09

[52] U.S. Cl. ..... 430/567; 430/569; 430/604; 430/605

[58] Field of Search ..... 430/567, 569, 604, 605

[56] References Cited

U.S. PATENT DOCUMENTS 3,901,713 8/1975 Yamasue et al. ..... 430/569
5,070,008 12/1991 Maekawa et al. ..... 430/605

FOREIGN PATENT DOCUMENTS 509674 10/1992 European Pat. Off. ..... 430/604
3-4221 1/1991 Japan ..... 430/604

OTHER PUBLICATIONS

United States Statutory Invention Registration H1092 to Kobayashi et al., Aug. 4, 1992.

*Primary Examiner*—Janet C. Baxter
*Attorney, Agent, or Firm*—Bierman and Muserlian; Jordan B. Bierman

[57] ABSTRACT

A silver halide emulsion comprises silver halide grains having a silver chloride content of not less than 10 mol % and a silver bromide content of not less than 0.1 mol % the silver halide grains being formed in the presence of at least one of compounds represented by the following Formula I:

Formula I $$Y_{n1}MBr_{n2}X_{n3}$$

wherein M represents an ion selected from the group consisting of rhenium, ruthenium, osmium, platinum, palladium, and iridium ion; Y represents a cation; X represents a ligand coordinating M; $n_1$ represents an integer of 0 to 3; and $n_2$ and $n_3$ each represent an integer, provided that $n_2 \geqq n_3$ and $n_2+n_3=4$ or 6.

5 Claims, No Drawings

SILVER HALIDE EMULSION AND SILVER HALIDE PHOTOGRAPHIC LIGHT-SENSITIVE MATERIAL

FIELD OF THE INVENTION

The present invention relates to a silver halide emulsion and a silver halide photographic light-sensitive material, and more particularly to a silver halide emulsion and a silver halide photographic light-sensitive material excellent in properties of high contrast gradation and reciprocity law failure and also excellent in latent image stability.

BACKGROUND OF THE INVENTION

Recently, rapid processing has been demanded for a light-sensitive material for a color paper in order to finish a large amount of prints in a short delivery time. As one method, there is known a method to enhance the speed of color developing by the use of a silver chloride emulsion or a silver bromochloride emulsion having a high silver chloride content as a silver halide emulsion. For example, the above-mentioned technology is disclosed in U.S. Pat. Nos. 4,183,756 and 4,225,666 and Japanese Patent Publication Open to Public Inspection (hereinafter referred to as Japanese Patent O.P.I. Publication) Nos. 26589/1980, 91444/1983, 95339/1983, 94340/1983, 95736/1983, 106538/1983, 107531/1983, 107532/1983, 107533/1983, 108533/1983 and 125612/1983.

However, silver chloride emulsions or silver bromochloride emulsions having a high silver chloride content have problems in that fogging is noticeable, sensitivity is low and fluctuation in sensitivity and gradation due to reciprocity law failure, namely due to exposure intensity, is great. In order to solve the above-mentioned problems, various studies have been conducted. In Japanese Patent O.P.I. Publication Nos. 139323/1976 and 171947/1984, technologies to improve processing stability and reciprocity law failure by adding compounds containing a metal in the 8th group of the periodic table are disclosed.

However, the above-mentioned technologies are not sufficient to solve the above-mentioned problems on silver chloride or silver halide having a high silver chloride content. In addition, in Japanese Patent O.P.I. Publication No. 183647, a technology to enhance sensitivity, to improve reciprocity law failure and also to improve fluctuation of sensitivity and gradation caused by a change of temperature in exposure is disclosed.

It is commonly known that doping of iridium compounds is effective for improvement in reciprocity law failure of silver halide emulsions. In Japanese Patent O.P.I. Publication No. 4935/1968, a technology to obtain small fluctuation in terms of gradation in a wide range of exposure time by adding an iridium compound when preparing silver halide grains is disclosed. In addition, there is disclosed a technology to improve sensitivity law failure by removing iridium from the surface of silver halide grains in U.S. Pat. No. 4,997,751.

While most of the above-mentioned problems were solved by the above-mentioned technologies, there still remains a problem that change in sensitivity is great (latent image stability is poor) depending upon intervals of time between exposure and processing. Especially, it is disclosed by Twickey in Journal of Photographic Science Volume 33, p 201 that a technology to dope an iridium compound known as a compound for improving reciprocity law failure noticeably deteriorates latent image stability at an initial stage after exposure, though the problem of reciprocity law failure is surely solved. Therefore, it is not desirable practically. In Japanese Patent O.P.I. Publication No. 135832/1980, it is disclosed that high sensitivity and improvement in reciprocity law failure can be achieved by doping cadmium, lead, copper and zinc. However, according to the study of the present inventors, it has been found that enhancement in high sensitivity and improvement in reciprocity law failure cannot be achieved concurrently and that initial latent image stability is deteriorated.

In Japanese Patent O.P.I. Publication No. 188437/1991, a technology to improve reciprocity law failure and to reduce fluctuation in developing density caused by the period of time from exposure to processing by adding an iridium compound and an iron compound on the surface layer side by 50% or more of grain volume. However, according to the study of the present inventors, it is found that problems still remain practically in that gradation fluctuates due to the period of time from exposure to processing while reciprocity law failure is improved when employing the above-mentioned technologies and that contrast is lowered due to inactive processing.

In Japanese Patent O.P.I. Publication No. 105940/1991, a technology to improve initial latent image stability by doping iridium in a specific region is disclosed. However, further improvement is necessary thereto. In the above-mentioned technology, there is no description about an iridium compound having a bromide ligand. The compound employed is $K_3IrCl_6$. In Japanese Patent O.P.I. Publication No. 9034/1992, $K_3IrCl_6$ is employed in a pure silver chloride emulsion not containing bromide ion in a comparative example of the Examples. It is very undesirable, being poor in latent image stability and having low contrast compared with $K_3IrCl_6$ employed in a comparative example in the same manner.

According to our study, it was found that emulsions containing bromide ion by the use of $K_3IrBr_6$ have especially excellent latent image stability. In addition, though Japanese Patent O.P.I. Publication discloses an iridium compound having a chloride ligand, no description about a bromide ligand is observed at all.

In addition, when iridium compounds having a chloride ligand are employed, it was found that silver chloride, especially having a high silver chloride content ratio, and silver bromochloride are not desirable because they cause tailing phenomenon (a phenomenon wherein density is enhanced slightly on the amount of exposure at an extremely low exposure region) producing blurred photography.

Studies for employing polyvalent metal compounds in a silver halide emulsion have long been tried. In Basis for Photography edited by Japan Photographic Society, published by CORONA PUBLISHING CO., LTD, 1978 on page 545, a technology is given to dope $Cd^{2+}$, $Pd^{2+}$, $Cu^{2+}$or trivalent metal in order to produce electron trap. In Research Disclosure Journal Volume 176 (December of 1978) RD-17643, a technology is given to prepare a direct print emulsion in the presence of tin, lead, copper, cadmium, bismuth, magnesium, rhodium and iridium. U.S. Pat. No. 3,923,513 describes that 4-valent ions such as lead, antimony, bismuth, arsenic, gold, iridium, rhodium, platinum, osmium and iridium are useful for internal-image emulsions described therein. Japanese Patent O.P.I. Publication No. 285941/1989 describes preventing fluctuation in sensitivity and gradation caused by a period of time by the aquation of noble metals of the 8th group. Japanese Patent O.P.I. Publication No. 56238/1990 describes composition distribution of AgCl and metals of the 8th group. Japanese Patent O.P.I. Publication No. 20852/1990 describes silver halide emulsions containing a complex of transition metals having a nitrosyl or thionitrosyl ligand. Japanese Patent O.P.I. Publication No. 20853/1990 describes enhancement of sensitivity achieved by the use of osmium, iridium, rhenium and ruthenium complexes having a cyano ligand. Japanese Patent O.P.I. Publication No. 20855/1990 describes a technology to change the properties of emulsion by adding face-centered cubic grains and Re compound into a silver halide emulsion, wherein the problem of reciprocity law failure at low intensity is reduced by adding rhenium pentabromide complex into a silver bromide emulsion or a silver bromoiodide emulsion.

However, despite the above-mentioned technologies, a satisfactory emulsion in terms of high-contrast gradation property, reciprocity law failure and initial latent image stability has not been obtained.

SUMMARY OF THE INVENTION

An object of the present invention is to provide a silver halide emulsion and a silver halide photographic light-sensitive material excellent in high-contrasted gradation property and reciprocity law failure and also excellent in latent image stability.

The above-mentioned objects of the present invention are attained by a silver halide emulsion or a silver halide photographic light-sensitive material of the following items (1) to (3).

(1) A silver halide emulsion comprising silver halide grains having a silver chloride content of not less than 10 mol % and a silver bromide content of not less than 0.1 mol %, wherein the silver halide grains contain at least one kind of compound represented by the following Formula I inside of or on the surface of the grains, or the silver halide grains are formed in the presence of the compound.

Formula I $$Y_{n_1}MBr_{n_2}X_{n_3}$$

wherein M represents an ion selected from the group consisting of a rhenium, ruthenium, osmium, platinum, palladium, and iridium ion; Y represents a cation; X represents a ligand coordinating M; $n_1$ represents an integer of 0 to 3; and $n_2$ and $n_3$ each represent an integer, provided that $n_2 \geqq n_3$ and $n_2+n_3=4$ or 6.

(2) The silver halide emulsion described in item (1) subjected to gold sensitization or gold sulfur sensitization.

(3) A silver halide photographic light-sensitive material containing a silver halide emulsion described in items (1) or (2).

Hereunder, we will explain the present invention in detail.

DETAILED DESCRIPTION OF THE INVENTION

In the present invention, in order to produce silver halide grains in the presence of a compound represented by Formula I (hereinafter referred to as "compound I"), there is means to add compound I to a kettle before the grains are produced or means to add compound I consecutively or at one time while the grains are being produced. It is preferable that compound I is contained in the silver halide grains.

The silver halide grains of the present invention are preferably silver bromochloride grains substantially not containing iodide. In addition, the silver chloride content of the silver halide grains is preferably not less than 95 mol % and not more than 99.9 mol %, and more preferably 98–99.9 mol % and most preferably 99.3% to 99.9 mol %. The silver bromide content is preferably 0.1–2.0 mol %, and more preferably, 0.1–0.7 mol %.

Silver halide grains of the present invention may have a uniform composition or localized phase of silver bromide on the surface or inside thereof. Silver halide emulsions of the present invention may contain silver halide grains other than silver halide grains of the present invention.

In addition, in a silver halide emulsion layer containing silver halide grains having a silver chloride content of not less than 90 mol %, the ratio of silver halide grains having a silver chloride content of not less than 90 mol % to the total silver halide grains contained in aforesaid emulsion layer is preferably not less than 60 mol % and more preferably not less than 80 mol %.

There is no limitation to the grain diameter of a silver halide grain. However, considering rapid processing property, sensitivity and other photographic properties, it is preferably 0.2–1.6 μm and more preferably 0.25–1.2 μm. The grain diameter of the above-mentioned grains can be measured by various methods employed ordinarily in the art. Typical ones are described in Analysis Methods for Grain Diameter (A.S.T.M. Symposium on Light Microscopy, 1955, pp. 94–122) or 2nd chapter in Theory of Photographic Process (Written by Mees and James, 3rd edition, published by MacMillan Publishing Co., Inc. (1966).

The grain diameter of silver halide grains can be calculated by the use of the projected area of grains or the approximate value thereof.

When the shape of grains is substantially uniform, grain distribution can be represented almost exactly by the use of a diameter or a projected area. Grain distribution of silver halide grains is poly-dispersed or mono-dispersed. Preferable is a mono-dispersed silver halide having variation coefficient of not more than 0.22 in grain distribution of silver halide grains and more preferable is one having a variation coefficient of not more than 0.15. Here, variation coefficient represents a coefficient indicating a width of the distribution of the grain diameter, and it is defined by the following.

Variation coefficient = S/R (S represents the standard deviation of grain diameter distribution and R represents an average grain diameter.)

wherein grain diameter is referred to as a diameter in the case of spherical silver halide grains, and a diameter when the projection of grains is converted to a sphere having the same area when the form of grains is cubic or other than spherical.

For an apparatus and a method for preparing silver halide emulsions, various kinds of conventional methods can be employed.

Silver halide emulsions of the present invention may be prepared by either of an acid method, a neutrality method or an ammonium method. Aforesaid grains may be grown at one time or may be grown after preparing seed grains. A method of preparing seed grains and a method of growing them may be the same or different.

As a method to react soluble silver halide and soluble chalogenized salt, any of a normal precipitation method, a reverse precipitation method, a simultaneous precipitation method and combinations thereof may be employed. Of them, a simultaneous precipitation method is preferable. In addition, as a style of a simultaneous precipitation method, the pAg controlled double jet method described in Japanese Patent O.P.I. Publication No. 48521/1979 can be employed.

In addition, an apparatus to feed aqueous solutions containing hydrophilic silver salt and hydrophilic chalogenized substance salt from an apparatus placed in a reacting initial liquid described in Japanese Patent O.P.I. Publication Nos. 92523/1982 and 92524/1982, an apparatus described in German Patent No. 2921164 wherein the density of hydrophilic silver salts and hydrophilic halogenized substance salt aqueous solutions are consecutively changed for addition and an apparatus described in Japanese Patent Publication No. 501776/1981 for forming grains while keeping distance between silver halide grains constant by taking out the reacting initial liquid from the reactor and condensing it by the use of an ultra-filtration method.

In addition, if necessary, silver halide solvents such as thioether may be employed. In addition, compounds having a mercapto group, nitrogen-containing heterocyclic compounds or sensitizing dyes may be added to silver halide grains when they are formed or after formation of grains is finished.

An arbitrary form of silver halide grains of the present invention may be employed. One preferable example is a cube having {100} plane as a crystal surface. In addition, grains having octahedral, tetradecahedral or dodecahedral forms can be prepared by the use of methods described in U.S. Pat. Nos. 4,183,756 and 4,225,666 and Japanese Patent O.P.I. Publication No. 26589/1980, Japanese Patent Publication No. 42737/1980 and The Journal of Photographic Science (J. Photogr. Sci) 21,39 (1973). In addition, grains having a twinned crystal may be employed.

For silver halide grains of the present invention, a uniform shape of grains may be employed, or grains wherein various shapes are mixed may also be employed.

In the present invention, metal ions can be added inside silver halide grains and/or on the surface thereof by the use of cadmium salt, zinc salt, lead salt or their complex salts, rhodium salt or its complex salts or iridium salts or its complex salt not in the present invention in the course of forming silver halide grains and/or in the course of growing them. In addition, by inserting silver halide grains in an appropriate reductive solution, reductive sensitization nuclei can be provided thereto inside of or on the surface of grains.

Unnecessary soluble salts can be removed from an emulsion containing silver halide grains after the growth of silver halides has finished, or the above-mentioned emulsion is allowed to keep containing them. When removing aforesaid salts, they can be removed by a method described in Research Disclosure No. 17643.

Silver halide grains employed in an emulsion of the invention may be grains wherein latent images are formed on the surface thereof or may be grains wherein they are formed inside the grains. Of them, the most preferable are surface-latent-image-forming type silver halide grains wherein latent images are mainly formed on the surface thereof.

In addition, an emulsion can be sensitized optically to a desired wavelength region by employing a sensitizing dye. As sensitizing dyes, cyanine dyes, merocyanine dyes, complex cyanine dyes, complex merocyanine dyes, horocyanine dyes, hemicyanine dyes, styryl dyes and hemioxanol dyes can be employed.

Silver halide emulsions employed in the present invention can be sensitized by the use of a sensitization method employing a reductive substance, a sensitization method employing chalcogen sensitizer and a sensitization method employing noble metal compounds. The above-mentioned sensitization methods can be employed in combination. Of them, sulfur sensitization, gold sensitization and gold-sulfur sensitization which is a combination thereof are especially preferable for the present invention.

Chalcogen sensitizers applicable to silver halide emulsions employed in the present invention include sulfur sensitizers, selenium sensitizers and tellurium sensitizers. Of them, sulfur sensitizers are preferable. As a sulfur sensitizer, thiosulfate salt, arylthiocarbamydo thiourea, arylisothiacyanate, cystine, p-toluenethiosulfonic acid salt and rhodanine are cited.

Compounds represented by Formula I of the present invention are those called ordinarily complex salts or complex. Among metals represented by M in Formula I, preferable are iridium, palladium and platinum. The more preferable is iridium. Ligand represented by X is halogen, $H_2O$, amine or OH.

Hereunder, we will illustrate examples of compounds represented by Formula I. However, the present invention is not limited thereto.

(1) $K_3RuBr_6$, (2) $K_2RuBr_6$, (3) $Na_3RuBr_6$, (4) $Na_2RuBr_6$, (5) $K_3RuBr_4Cl_2$, (6) $K_2RuBr_4Cl_2$, (7) $K_2RuBr_3Cl_3$, (8) $K_3RuBr_3Cl_3$, (9) $K_3RuBr_5Cl$, (10) $K_2RuBr_5Cl_1$, (11) $K_3RuBr_5(H_2O)$, (12) $K_3RuBr_5(H_2O)_2$, (13) $K_3RuBr_5I$, (14) $K_2RuBr_5I$, (15) $K_3IrBr_6$, (16) $K_2IrBr_6$, (17) $Na_3IrBr_6$, (18) $Na_2IrBr_6$, (19) $K_3IrBr_4Cl_2$, (20) $K_2IrBr_4Cl_2$, (21) $K_2IrBr_3Cl_3$, (22) $K_3IrBr_3Cl_3$, (23) $K_3IrBr_5Cl$, (24) $K_2IrBr_5Cl_1$(25) $K_3IrBr_5(H_2O)$, (26) $K_3IrBr_5(H_2O)_2$, (27) $K_3IrBr_5I$, (28) $K_2IrBr_5I$, (29) $K_3OsBr_6$, (30) $K_2OsBr_6$, (31) $Na_3OsBr_6$, (32) $Na_2OsBr_6$, (33) $K_3OsBr_4Cl_2$, (34) $K_2OsBr_4Cl_2$, (35) $K_2OsBr_3Cl_3$, (36) $K_3OsBr_3Cl_3$, (37) $K_3OsBr_5Cl$, (38) $K_2OsBr_5Cl_1$, (39) $K_3OsBr_5(H_2O)$, (40) $K_3OsBr_5(H_2O)_2$, (41) $K_3OsBr_5I$, (42) $K_2OsBr_5I$, (43) $K_3ReBr_6$, (44) $K_2ReBr_6$, (45) $Na_3ReBr_6$, (46) $Na_2ReBr_6$, (47) $K_3ReBr_4Cl_2$, (48) $K_2ReBr_4Cl_2$, (49) $K_2ReBr_3Cl_3$, (50) $K_3ReBr_3Cl_3$, (51) $K_3ReBr_5Cl$, (52) $K_2ReBr_5Cl_1$, (53) $K_3ReBr_5(H_2O)$, (54) $K_3ReBr_5(H_2O)_2$, (55) $K_3ReBr_5I$, (56) $K_2ReBr_5I$, (57) $K_2PdBr_4$, (58) $K_2PdBr_6$, (59) $Na_2PdBr_4$, (60) $K_2PtBr_4$, (61) $K_2PtBr_6$

As a noble metal sensitizer applicable to silver halide emulsions employed in the present invention, gold sensitization is preferable. In a gold sensitizer, the number of oxidation of gold is allowed to be mono-valent or tri-valent. Chloroaurate and potassium chloroaurate are allowed to be employed.

It is common that dye-forming couplers employed for silver halide photographic light-sensitive materials of the present invention are selected in the manner that, in each emulsion layer, dyes which absorb light-sensitive spectral light and sensitize aforesaid emulsion are formed. To blue sensitive emulsion layers, yellow dye forming couplers are employed. To green sensitive emulsion layers, magenta dye forming couplers are formed. To red sensitive emulsion layer, cyan dye forming couplers are employed. However, depending upon the purpose, silver halide color photographic light-sensitive materials may be prepared through a combination different from the combination described above.

To light-sensitive materials of the present invention, anti-color fogging agents, image stabilizers, hardeners, plasticizers, anti-irradiation dyes, polymer latex, UV absorbers, formalin scavengers, development accelerators, fluorescent brightening agents, matting agents, lubricants, anti-static agents and surfactants can arbitrarily be added. The above-mentioned compounds are described in Japanese Patent O.P.I. Publication Nos. 215272 and 46436. The light-sensitive materials of the present invention can form images by being subjected to conventional color developing.

EXAMPLES

Hereunder, we will show examples of the present invention. However, the present invention is not limited thereto.

Example 1

To 1000 ml of 2% aqueous gelatin solution kept at 40° C., Solution A and Solution B mentioned below were added simultaneously in 30 minutes while controlling pAg to 6.5 and pH to 3.0. Next, Solution C and Solution D were added simultaneously in 120 minutes while controlling pAg to 7.3 and pH to 5.5. In this case, pAg was controlled by the use of a method described in Japanese Patent O.P.I. Publication No. 45437/1984, and pH was controlled employing sulfuric acid and an aqueous sodium hydroxide solution.

| | |
|---|---|
| (Solution A) | |
| Sodium chloride | 3.42 g |
| Potassium bromide | 0.03 g |
| Water was added to make 200 ml. | |
| (Solution B) | |
| Silver nitrate | 10 g |
| Water was added to make 200 ml. | |
| (Solution C) | |
| Sodium chloride | 78.7 g |
| Potassium bromide | 0.157 g |
| Water was added to make 446 ml. | |
| (Solution D) | |
| Silver nitrate | 190 g |
| Water was added to make 380 ml. | |

The resulting solution was subjected to desalting employing a 10% aqueous solution of Demol N produced by Kao Atlas and a 30% aqueous solution of magnesium sulfate. Next, the mixed solution was mixed with a gelatin aqueous solution. Thus, a mono-dispersed cubic silver halide emulsion EMP-1 having an average grain diameter of 0.40 μm, variation coefficient (standard deviation/average grain diameter) of 0.07 and a silver chloride content of 99.9 mol % was prepared.

EMP-1 was subjected to the most suitable sensitization employing the following compounds at 65° C. so that a green sensitive silver halide emulsion Em-1 was prepared.

Sodium thiosulfate 1.5 mg/mol of AgX
Stabilizer SB-1 $6\times10^{-4}$ mol/AgX
Sensitizing dye GS-1 $3\times10^{-4}$ mol/AgX

SB-1

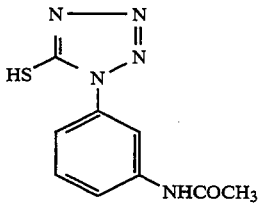

GS-1

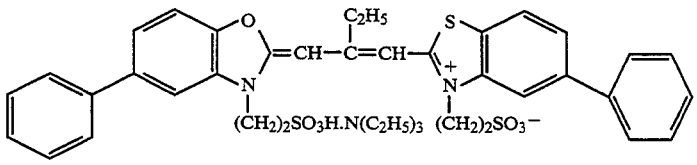

Next, silver halide emulsion Em-2 was prepared in the same way as in Em-1 except that a compound I-(16) in quantity of $1\times10^{-8}$ mol per mol of silver was added to Solution C.

Emulsions shown in Table 2 were prepared employing exemplified compounds shown in Table 2 in place of Compound I-(16) which was added to Em-2. In addition, emulsions shown in Table 2 were prepared as comparative samples employing the following compounds IR-1 to IR-6 in place of Compound I-(16) of Em-2.

IR-1 : $K_2IrCl_6$
IR-2 : $K_2ReCl_6$
IR-3 : $K_3[RuCl_5NO]$
IR-4 : $K_2PtCl_4$
IR-5 : $K_2PdCl_4$
IR-6 : $K_2OsCl_6$

Each of the following layer was coated on a support wherein polyethylene is contained on one side of a support and titanium oxide was coated on the other side (a side on which photographic structural layers were coated) of a support so that Sample No. 101 was prepared.

TABLE 1

| Layer | Additive | Amount of adding ($g/m^2$) |
|---|---|---|
| Second layer | Gelatin | 1.0 |
| First layer (Green sensitive) | Em-1 | 0.36 in conversion to silver amount |
| | Magenta coupler (MM-1) | 0.35 |
| | Dye image stabilizer (ST-3) | 0.15 |
| | Dye image stabilizer (ST-4) | 0.15 |
| | Dye image stabilizer (ST-5) | 0.15 |
| | TOP | 0.2 |
| Support | Polyethylene laminated | |

TABLE 1-continued

| Layer | Additive | Amount of adding ($g/m^2$) |
|---|---|---|
| | paper | |

Incidentally, H-1 was added to the second layer as a hardener.

H-1

$C(CH_2SO_2CH{=}CH_2)_4$

Samples Nos. 102 to 114 were prepared in the same manner as in Sample No. 101 except that Em-2 to Em-14 were employed respectively in place of Em-1 of Sample No. 101.

Properties of samples obtained in the above-mentioned manner were evaluated under the following method. Table 2 shows the results thereof.

(1) Sensitometry

Samples were subjected to wedge exposure to green light for 0.05 seconds, and then subjected to color developing under the following processing steps. Then, their densities were measured employing an optical densitometer (Model PDA-65, produced by Konica), and the sensitivity thereof was represented by a logarithm of an inverse of the exposure amount necessary for obtaining a density higher than fog density by 0.8. Incidentally, gradation $\gamma_2$ is represented by an inverse of the difference of exposure amount between a density higher than fog density by 0.2 and a density higher than fog density by 0.7.

(2) Reciprocity Law Failure

Samples were subjected to wedge exposure to green light for 10 seconds so that the exposure amount was the same as above, and then, subjected to the sensitometry in the same manner as above. Sensitivity of each sample was represented by relative sensitivity when the sensitivity obtained under the 0.05 second exposure was defined to be 100.

(3) Fog Density

Unexposed samples were subjected to color developing. The density thereof was measured employing an optical densitometer (Model PDA-65, produced by Konica).

(4) Latent Image Stability

The densities of a sample subjected to developing 10 seconds after exposure with green light and a sample subjected to developing 5 minutes after exposure with green light respectively were measured employing a densitometer Model PDA-65 produced by Konica. Then, the difference $\Delta\gamma_2$ between gradation obtained when a sample was developed 5 minutes after exposure and that obtained when a sample was developed 10 seconds after exposure was calculated.

$\Delta\gamma_2 = \gamma_2$ (developed 5 minutes after exposure) $- \gamma_2$ (developed 10 seconds after exposure)

$\gamma_2$: Inverse of the difference of exposure amount between the density higher than fog density by 0.2 and the density higher than fog density by 0.7.

Processing conditions employed for evaluation were as follows.

| Processing step | Temperature | Time |
|---|---|---|
| Color developing | 35 ± 0.3° C. | 45 seconds |
| Bleach-fixing | 35 ± 0.5° C. | 45 seconds |
| Stabilizing | 30 – 34° C. | 90 seconds |
| Drying | 60 – 80° C. | 60 seconds |

| | |
|---|---|
| Color developer | |
| Pure water | 800 ml |
| Triethanol amine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphate | 1.0 g |
| Ethylenediaminetetraacetate | 1.0 g |
| Disodium catecol-3,5-diphosphate | 1.0 g |
| N-ethyl-N-β-methanesulfonamidoethyl-3-methyl-4-aminoaniline sulfate | 4.5 g |
| Fluorescent brightening agent (4,4'-diaminostylbenzsulfonic acid derivative) | 1.0 g |
| Potassium carbonate | 27 g |
| Water is added to make 1 l in total, and pH is regulated to 10.10. | |
| Bleach-fixer | |
| Ammonium ferric ethylenediamine tetraacetic acid bihydrate | 60 g |
| Ethylenediamine tetraacetic acid | 3 g |
| Ammonium thiosulfate (70% aqueous solution) | 100 ml |
| Ammonium sulfite (40% aqueous solution) | 27.5 ml |
| Water was added to make 1 l in total, and pH was regulated with potassium carbonate or glacial acetate. | |
| Stabilizer | |
| 5-chloro-2-methyl-4-isothiazoline-3-on | 1.0 g |
| Ethyleneglycol | 1.0 g |
| 1-hydroxyethylidene-1,1-diphosphate | 2.0 g |
| Ethylenediaminetetraacetate | 1.0 g |
| Ammonium hydroxide (20% aqueous solution) | 3.0 g |
| Fluorescent brightening agent (4,4'-diaminostylbenzsulfonic acid derivative) | 1.5 g |
| Water was added to make 1 l in total, and pH was regulated to 7.0 with sulfuric acid or potassium hydroxide. | |

TABLE 2

| Sample | Emulsion | Compound I | Sensitivity | Gradation | Reciprocity law failure | Latent image stability | Note |
|---|---|---|---|---|---|---|---|
| 101 | Em-1 | — | 100 | 1.4 | 66 | +0.02 | Comp. |
| 102 | Em-2 | I-(16) | 78 | 2.4 | 78 | +0.02 | INV. |
| 103 | Em-3 | I-(6) | 75 | 2.0 | 72 | +0.03 | INV. |
| 104 | Em-4 | I-(44) | 79 | 1.9 | 75 | +0.04 | INV. |
| 105 | Em-5 | I-(1) | 80 | 2.0 | 71 | +0.04 | INV. |
| 106 | Em-6 | I-(30) | 82 | 1.8 | 75 | +0.04 | INV. |
| 107 | Em-7 | I-(60) | 78 | 2.1 | 76 | +0.03 | INV. |
| 108 | Em-8 | I-(59) | 82 | 2.2 | 78 | +0.03 | INV. |
| 109 | Em-9 | IR-1 | 78 | 1.8 | 78 | +0.08 | Comp. |
| 110 | Em-10 | IR-2 | 76 | 1.9 | 73 | +0.05 | Comp. |
| 111 | Em-11 | IR-3 | 80 | 1.7 | 74 | +0.07 | Comp. |
| 112 | Em-12 | IR-4 | 78 | 1.9 | 73 | +0.05 | Comp. |
| 113 | Em-13 | IR-5 | 82 | 1.8 | 74 | +0.04 | Comp. |

TABLE 2-continued

| Sample | Emulsion | Compound I | Sensitivity | Gradation | Reciprocity law failure | Latent image stability | Note |
|---|---|---|---|---|---|---|---|
| 114 | Em-14 | IR-6 | 84 | 1.8 | 76 | +0.05 | Comp. |

Comp.: Comparative
Inv.: Invention

As is apparent from Table 2, samples employing a bromide ligand could obtain extremely high-contrasted emulsions. In addition, it was found that their reciprocity law failure and latent image stability were excellent. Samples containing an iridium compound had defects in that sensitivity and latent image stability were deteriorated, though the reciprocity law failure was improved. On the contrary, it was found that, in the case of Sample 102 of the present invention, the reciprocity law failure was improved and latent image stability was rarely deteriorated compared with Sample 108.

Example 2

Emulsions were prepared in the same manner as in Em-2 and Em-9 of Example 1 except that sodium thiosulfate, sodium chloroaurate and SB-1 was employed in chemical sensitization, and were defined to be Em-15 and Em-16, respectively.

Samples wherein Em-15 and Em-16 were coated in the same manner as in Em-1 respectively were defined to be Sample 115 and Sample 116. These samples were subjected to evaluation in the same manner as in Example 1. Table 3 shows the results thereof.

TABLE 3

| Sample | Emulsion | Sodium chloroauric acid | Compound I | Sensitivity | Reciprocity law failure | Latent image stability | Note |
|---|---|---|---|---|---|---|---|
| 102 | Em-2 | no | I-(16) | 78 | 78 | +0.02 | INV. |
| 115 | Em-15 | yes | I-(16) | 189 | 80 | +0.03 | INV. |
| 109 | Em-9 | no | — | 78 | 78 | +0.08 | Comp. |
| 116 | Em-16 | yes | — | 190 | 81 | +0.43 | Comp. |

Inv.: Invention
Comp.: Comparative

Sample 116 subjected especially to sodium chloroaurate sensitization was so excellent in high sensitivity as to be superior to Sample 119. However, it was found that it has problems that reciprocity law failure and latent image stability are deteriorated. However, with regard to Sample 115 in the present invention, it was found that it has high sensitivity and extremely improved latent image stability though the reciprocity law failure is slightly deteriorated.

Example 3

In preparing EMP-1 of Example 1, time of addition for Solution A and Solution B and time of addition for Solution C and Solution D were modified so that a mono-dispersed cubic emulsion having an average grain diameter of 0.71 μm (length of one side of cubic), variation coefficient of 0.07 and a silver halide content ratio of 99.9 mol % was prepared. This emulsion was sensitized most appropriately at 65° employing sodium thiosulfate of 0.8 mg/molAgX, SB-1 of $6\times10^{-4}$ mol/mol AgX and sensitizing dye BS-1 of $4\times10^{-4}$ mol/mol AgX. The resulting emulsion was defined to be EMP-2.

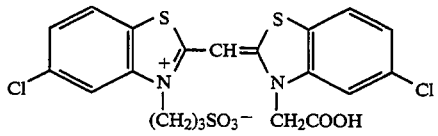

BS-1

Emulsions the same as EMP-2 except that I-16 or IR-1 were added respectively to $1\times10^{-8}$ mol/mol AgX of Solution C. The resulting emulsion were defined to be Em-17 and Em-18, respectively.

Emulsions the same as Em-17 and Em-18 except that 1.5 mg/mol AgX of sodium chloroaurate was added for sensitization were prepared. The resulting emulsions were defined to be Em-19 and Em-20.

A mono-dispersed cubic emulsion having an average grain diameter of 0.52 μm (in terms of a length of one side of cubic), variation coefficient of 0.07 and silver chloride content ratio of 99.9 mol % was prepared in the same manner as in EMP-1 of Example 1 except that the time of addition for Solution A and Solution B and the time of addition for Solution C and Solution D were changed. This emulsion was subjected to the most suitable sensitization at 67° C. by the use of 2.0 mg/mol AgX of sodium thiosulfate, $7\times10^{-4}$ mol/mol AgX of SB-1 and $7\times10^{-5}$ mol/mol AgX of sensitization dye RS-1. The resulting emulsion was defined to be EMP-3.

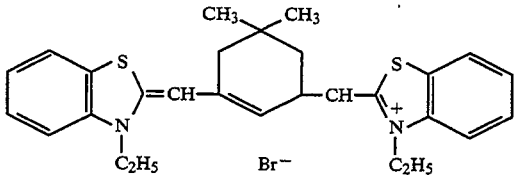

RS-1

Emulsions the same as EMP-3 except that $1\times10^{-8}$ mol/mol AgX of I-16 and IR-1 were respectively added to Solution C were prepared. The resulting emulsions were defined to be Em-21 and Em-22.

Emulsions the same as Em-21 and Em-22 except that 0.3 mg/mol AgX of sodium chloroaurate was added were prepared. The resulting emulsions were defined to be Em-23 and Em-24.

On a paper support wherein polyethylene was laminated on one side thereof and polyethylene containing titanium oxide was laminated on the other side (on which photographic structural layers were coated), there were coated layers having the following constitution so that multi-layer silver halide color photographic light-sensitive material 201 was prepared.

The coating solution was prepared as follows.

First Layer Coating Solution

To 26.7 g of Yellow coupler Y-1, 10.0 g of Dye image stabilizer ST-1, 6.67 g of ST-2, 0.67 g of Additive HQ-1 and 6.67 g of high boiling organic solvent DNP, 60 ml of ethyl acetate was added to obtain a solution. The solution was emulsified and dispersed into 220 ml of 10% aqueous gelatin solution containing 7 ml of 20% surfactant SU-1. Thus, Yellow coupler dispersion solution was prepared. To this dispersion solution, anti-mildew agent F-1 was added. This dispersion solution was mixed with a blue sensitive silver halide emulsion (containing 8.67 g of silver) prepared under the following conditions so that Coating solution for the first layer was prepared.

Coating solutions for 2nd layer to 7th layer were prepared in the same manner as in the above-mentioned Coating solution for the 1st layer. In addition, H-2 was added to 2nd layer and 4th layer and H-1 was added to 7th layer as hardeners. As coating aids, Surfactants SU-2 and SU-3 were added for regulating surface tension. Tables 4 and 5 show the constitution of the above-mentioned each layer.

TABLE 4

| Layer | Constitution | Amount of adding (g/m²) |
|---|---|---|
| Seventh layer (Protective) | Gelatin | 1.00 |
| Sixth layer (UV absorbing) | Gelatin | 0.40 |
| | UV absorber (UV-1) | 0.10 |
| | UV absorber (UV-2) | 0.04 |
| | UV absorber (UV-3) | 0.16 |
| | Anti stain agent (HQ-1) | 0.01 |
| | DNP | 0.20 |
| | PVP | 0.03 |
| | Anti irradiation dye (AIC-1) | 0.02 |
| Fifth layer (Red sensitive) | Gelatin | 1.30 |
| | Red sensitive silver bromochloride emulsion (Em-R) | 0.21 |
| | Cyan coupler (EC-1) | 0.24 |
| | Cyan coupler (EC-2) | 0.08 |
| | Dye image stabilizer (ST-1) | 0.20 |
| | Anti stain agent (HQ-1) | 0.01 |
| | HBS-1 | 0.20 |
| | DOP | 0.20 |
| Fourth layer (UV absorbing) | Gelatin | 0.94 |
| | UV absorber (UV-1) | 0.28 |
| | UV absorber (UV-2) | 0.09 |
| | UV absorber (UV-3) | 0.88 |
| | Anti stain agent (HQ-1) | 0.03 |
| | DNP | 0.40 |

TABLE 5

| Layer | Constitution | Amount of adding (g/m²) |
|---|---|---|
| Third layer (Green sensitive) | Gelatin | 1.40 |
| | Green sensitive silver bromochloride emulsion (Em-G) | 0.17 |
| | Magenta coupler (MM-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Anti-irradiation dye (AIM-1) | 0.01 |
| Second layer (Intermediate) | Gelatin | 1.20 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.06 |
| | Anti-mildew agent (F-1) | 0.002 |

TABLE 5-continued

| Layer | Constitution | Amount of adding (g/m²) |
|---|---|---|
| First layer (Blue sensitive) | Gelatin | 1.2 |
| | Blue sensitive silver bromochloride emulsion (Em-B) | 0.26 |
| | Yellow coupler (YY-1) | 0.80 |
| | Dye image stabilizer (ST-1) | 0.30 |
| | Dye image stabilizer (ST-2) | 0.20 |
| | Anti-stain agent (HQ-l) | 0.02 |
| | Anti-irradiation dye (AIY-1) | 0.01 |
| | DNP | 0.20 |
| Support | Polyethylene laminated paper | |

*Added amounts of silver halide emulsion were represented in terms of silver.

Y-1

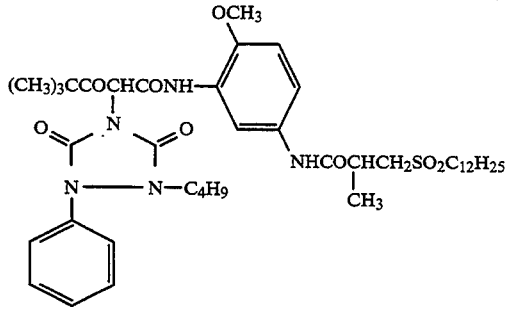

ST-1

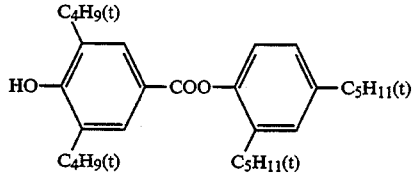

ST-2

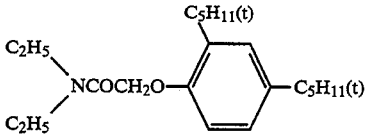

HQ-1

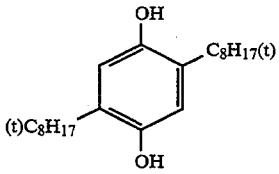

F-1

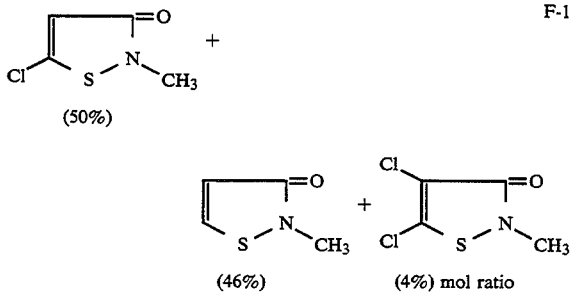

H-2

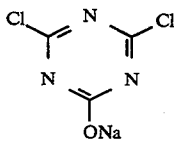

-continued

SU-1

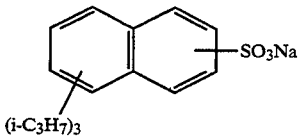

SU-2

$$NaO_3S-\underset{\underset{CH_2COOCH_2CHC_4H_9}{|}}{CH}COOCH_2\overset{\overset{C_2H_5}{|}}{C}HC_4H_9$$

SU-3

$$NaO_3S-\underset{\underset{CH_2COOCH_2(CF_2CF_2)_2H}{|}}{CH}COOCH_2(CF_2CF_2)_2H$$

Samples 202 to 204 were prepared in the same manner as in Sample 201 except that emulsions used for each light-sensitive silver halide layers were replaced as shown in Table 6.

TABLE 6

| Sample | Emulsion layer Blue sensitive | Green sensitive | Red sensitive | Compound of the present invention I or comparative compound (IR) | Sensitization chloroauric acid |
|---|---|---|---|---|---|
| 201 | Em-17 | Em-2 | Em-21 | I-(16) | no |
| 202 | Em-18 | Em-1 | Em-22 | IR-1 | no |
| 203 | Em-19 | Em-15 | Em-23 | I-(16) | yes |
| 204 | Em-20 | Em-16 | Em-24 | IR-1 | yes |

The resulting samples were subjected to exposure and processing in the same manner as in Example 1 except that the color of filter used in exposure was changed to blue, green and red. They were subjected to evaluation in the same manner as in Example 1. Incidentally, sensitivity was represented by a relative sensitivity when the sensitivity of Sample 201 was defined to be 100. Table 7 shows the results thereof.

TABLE 7

| | Sample | Speed | Reciprocity law failure | Latent image stability | Gradation | Note |
|---|---|---|---|---|---|---|
| 201 | Blue sensitive layer | 100 | 81 | +0.02 | 2.25 | Inv. |
| | Green sensitive layer | 100 | 78 | +0.02 | 2.30 | |
| | Red sensitive layer | 100 | 79 | +0.03 | 2.22 | |
| 202 | Blue sensitive layer | 98 | 82 | +0.04 | 1.45 | Comp. |
| | Green sensitive layer | 98 | 80 | +0.04 | 1.50 | |
| | Red sensitive layer | 100 | 81 | +0.05 | 1.34 | |
| 203 | Blue sensitive layer | 220 | 79 | +0.03 | 2.11 | Inv. |
| | Green sensitive layer | 224 | 80 | +0.03 | 2.2 | |
| | Red sensitive layer | 218 | 80 | +0.02 | 2.32 | |
| 204 | Blue sensitive layer | 217 | 82 | +0.42 | 1.85 | Comp. |
| | Green sensitive layer | 226 | 82 | +0.44 | 1.8 | |
| | Red sensitive layer | 224 | 86 | +0.40 | 1.75 | |

Inv.: Invention
Comp.: Comparative

From Table 7, it is found that multi-layer silver halide color light-sensitive material of the present invention can offer noticeable effects. It is especially found that Sample 203 subjected to chemical sensitization by the use of sodium chloroaurate is remarkably excellent in terms of latent image stability compared with Sample 204 subjected to sensitization in the same manner.

Namely, it was found that the present invention can offer samples having high sensitivity and satisfactory reciprocity law failure and latent image stability when samples are chemically sensitized by the use of sodium chloroaurate.

Example 4

In reference to Japanese Patent O.P.I. Publication No. 183647/1989, an emulsion having a localized phase of silver bromide on the surface of grains was prepared.

To a 3% aqueous gelatin solution kept at 50° C., 6 g of sodium chloride was added. To the solution, a solution containing 10 g of silver nitrate and a solution containing 3.44 g of sodium chloride were added while stirring vigorously, followed by adding a solution containing 232 g of silver nitrate and 79.8 g of sodium chloride under rigorous stirring. Next, to the solution, 290 mg of sensitizing dye GS-1 was added. The mixture was stirred for 15 minutes. Then, to the mixture, an aqueous solution containing 8 g of silver nitrate and a solution containing 0.55 g of sodium chloride 0.5 g of potassium bromide were added and mixed at 40° C. while stirring vigorously. The solution was subjected to desalt, washing and re-dispersion in the same manner as in EMP-1. Thus, an emulsion having an average grain diameter of 0.40 μm and a variation coefficient of 0.07 was prepared. When the above-mentioned emulsion was subjected to X-ray diffraction measurement, the main peak of 100% of silver by chloride and the sub-peak of 60–90 mol % of silver chloride were obserbed. Therefore, it was found that grains wherein a silver bromide phase was localized was prepared. Next, the above-mentioned emulsion was subjected to the most suitable chemical sensitization employing sodium thiosulfate, sodium chloroaurate and the above-mentioned compound SB-1. The resulting emulsion was defined to be Em-25. To an aqueous solution containing 79.8 g of sodium chloride used in preparing Em-25, Compound I-16 was added in the same amount as Em-2 for preparation. By changing content amount of potassium bromide in preparing grains of Em-25 as shown in Table 7, emulsion Em-27 which was subjected to chemical sensitization in the same manner as in Em-25 was prepared. Next, emulsions Em-26 and Em-28 were prepared in the same manner as in Em-2 except that Br content ratio was changed. An emulsion subjected to chemical sensitization in the same manner as Em-25 was prepared. Employing the above-mentioned emulsions, coating samples Nos. 205 to 208 were prepared. They were subjected to evaluation in the same manner as Example 1.

From comparison between Sample 205 and Sample 208, it was found that the emulsion having localized phase of Br can offer a favorable sample in terms of reciprocity law failure and latent image stability having high sensitivity. In addition, from Samples 206 and 208, it was found that emulsions having Br content of 0.3% mol are more favorable.

What is claimed is:

1. A silver halide emulsion comprising silver halide grains having a minimum silver chloride content of 95 mol %, and a minimum silver bromide content of 0.1 mol %, wherein said silver halide grains are formed in the presence of at least one compound selected from the group consisting of $K_3IrBr_6$, $K_2IrBr_6$, $Na_3IrBr_6$, $Na_2IrBr_6$, $K_3IrBr_4Cl_2$, $K_2IrBr_4Cl_2$, $K_2IrBr_3Cl_3$, $K_3IrBr_3Cl_3$, $K_3IrBr_5Cl$, $K_2IrBr_5Cl$, $K_3IrBr_5(H_2O)$, $K_3IrBr_5(H_2O)_2$, $K_3IrBr_5I$, and $K_2IrBr_5I$.

2. The silver halide emulsion of claim 1, wherein said silver halide grains have a silver chloride content of 98 to 99.9 mol % and a silver bromide content ratio of 0.1 to 2.0 mol %.

3. The silver halide emulsion of claim 1, wherein said silver halide grains have a silver chloride content of 99.3 to 99.9 mol % and a silver bromide content of 0.1 to 0.7 mol %.

4. The silver halide emulsion of claim 1, wherein said silver halide grains are subjected to sulfur or gold sensitization.

5. A silver halide color photographic light-sensitive material comprising a support having provided thereon a silver halide emulsion layer containing a magenta dye-forming coupler, a silver halide emulsion layer containing a yellow dye-forming coupler, and a silver halide emulsion layer containing a cyan dye-forming coupler, each said silver halide emulsion layer containing silver halide grains having a minimum silver chloride content of 95 mol %, and a minimum silver bromide content of 0.1 mol %, said silver halide grains being formed in the presence of at least one compound selected from the group consisting of $K_3IrBr_6$, $K_2IrBr_6$, $Na_3IrBr_6$, $Na_2IrBr_6$, $K_3IrBr_4Cl_2$, $K_2IrBr_4Cl_2$, $K_2IrBr_3Cl_3$, $K_3IrBr_3Cl_3$, $K_3IrBr_5Cl$, $K_2IrBr_5Cl$, $K_3IrBr_5(H_2O)$, $K_3IrBr_5(H_2O)_2$, $K_3IrBr_5I$, and $K_2IrBr_5I$.

* * * * *